US012798850B2

(12) United States Patent
Wouters et al.

(10) Patent No.: US 12,798,850 B2
(45) Date of Patent: Nov. 17, 2026

(54) MULTIPLE BOTTLE CARRIER

(71) Applicant: DS SMITH PACKAGING LTD., London (GB)

(72) Inventors: Wim Wouters, Heresbach (BE); Peter Pieraets, Leuven (BE); Carlos Diaz, Brussels (BE); Ádám Horváth, Sopron (HU)

(73) Assignee: DS SMITH PACKAGING LTD., London (GB)

( * ) Notice: Subject to any disclaimer, the term of this patent is extended or adjusted under 35 U.S.C. 154(b) by 0 days.

(21) Appl. No.: 19/118,122

(22) PCT Filed: Oct. 5, 2023

(86) PCT No.: PCT/IB2023/059996
§ 371 (c)(1),
(2) Date: Apr. 3, 2025

(87) PCT Pub. No.: WO2024/075053
PCT Pub. Date: Apr. 11, 2024

(65) Prior Publication Data

US 2026/0125192 A1 May 7, 2026

(30) Foreign Application Priority Data

Oct. 6, 2022 (GB) ..... 2214678

(51) Int. Cl.
*B65D 71/44* (2006.01)

(52) U.S. Cl.
CPC ..... *B65D 71/44* (2013.01); *B65D 2571/0029* (2013.01); *B65D 2571/00444* (2013.01); *B65D 2571/0066* (2013.01)

(58) Field of Classification Search
CPC ..... B65D 71/44; B65D 71/42; B65D 71/40; B65D 2571/0029; B65D 2571/00432;
(Continued)

(56) References Cited

U.S. PATENT DOCUMENTS 2,299,625 A * 10/1942 Holmes ..... B65D 71/44
294/87.2
2,320,440 A * 6/1943 Kruea ..... B65D 71/406
215/396

(Continued)

FOREIGN PATENT DOCUMENTS

DE 202019105714 U1 11/2019
EP 2284094 A1 * 2/2011 ..... B65D 71/44
WO 9809883 A1 3/1998

OTHER PUBLICATIONS

European Patent Office, International Search Report issued in PCT/IB2023/059996, mailed Dec. 12, 2023, Rijswijk, NL.

(Continued)

*Primary Examiner* — Javier A Pagan
(74) *Attorney, Agent, or Firm* — Ferguson Case Orr Paterson

(57) ABSTRACT

A multiple bottle carrier of cardboard or the like cellulosic material has a center portion and two lateral portions which are orthogonally arranged with respect to the center portion and originate from a basis of the center portion. Each lateral portion has one or more holes, each of which is surrounded by a crown of adjacent separate tabs, whose folding upwards permits insertion of a neck of a respective bottle that is prevented from coming out of the hole. Each lateral portion has a longitudinal folding line which is intermediate between the basis of the center portion and a distal side of the lateral portion. A median aperture has an upper portion extending through the center portion and lower portions extending through a proximal part of each lateral portion. The upper portion of the median aperture allows insertion of hand fingers of a user.

18 Claims, 5 Drawing Sheets

(58) Field of Classification Search
CPC ..... B65D 2571/00438; B65D 2571/00444;
B65D 2571/0045; B65D 2571/00654;
B65D 2571/0066; B65D 2571/00666
See application file for complete search history.

(56) References Cited

U.S. PATENT DOCUMENTS

| | | | | | |
|---|---|---|---|---|---|
| 2,415,218 | A | * | 2/1947 | Rhodes | B65D 71/50 53/48.5 |
| 2,615,750 | A | * | 10/1952 | William | B65D 71/48 294/87.28 |
| 3,073,644 | A | * | 1/1963 | Baker | B65D 71/44 294/87.2 |
| 5,526,925 | A | | 6/1996 | Bernstein | |

OTHER PUBLICATIONS

European Patent Office, International Written Opinion issued in PCT/IB2023/059996, mailed Dec. 12.

* cited by examiner

MULTIPLE BOTTLE CARRIER

CROSS-REFERENCE TO RELATED APPLICATIONS

This application is a National Phase Application of PCT International Application No. PCT/IB2023/059996, having an International Filing Date of Oct. 5, 2023 which claims the benefit of priority to British Patent Application No. 2214678.1, filed Oct. 6, 2022, each of which is hereby incorporated by reference in its entirety.

FIELD OF THE INVENTION

The present invention relates to a multiple bottle carrier of cardboard or the like cellulosic material, having a center portion and two lateral portions which are substantially orthogonally arranged with respect to the center portion.

Conventionally, each lateral portion has a plurality of holes, each of which is surrounded by a crown of adjacent separate tabs, whose folding upwards permits insertion of a neck of the respective bottle and prevents the bottle from coming out of the hole due to its own weight. Additionally, the center portion has an aperture allowing the insertion of the fingers of a hand of a user who can thus comfortably grip the carrier in which the bottles have been inserted.

BACKGROUND OF THE INVENTION

Usually, packages formed by such a carrier and four or six bottles inserted therein are produced in a plant and successively transported to the points of sale, wherein the customer can grip the center portion of the carrier through the aperture and carry away the package.

EP 2 284 094 discloses a multiple bottle carrier having the above-captioned general features. Additionally, the center portion thereof is provided of fold lines in a region close to its top edge. Such fold lines allow the folding downwards of the top edge region of the carrier that, otherwise, would typically protrude beyond the horizontal plan defined by the top surfaces of the bottles inserted therein. Hence, a plurality of these packages can be easily and safely stacked on each other during transportation from production plant to the points of sales, and the successive storage therein until sale.

Nevertheless, the center portion, which is the most stressed part when gripped by the user during the carrying, is weakened by the presence of the fold lines and may be susceptible to ruptures.

SUMMARY OF THE INVENTION

An object of the present invention is the provision of a multiple bottle carrier which overcomes the above drawback of the prior art.

According to the present invention, this object is achieved by a multiple bottle carrier of cardboard or the like cellulosic material, comprising a center portion and two lateral portions which are substantially orthogonally arranged with respect to the center portion and originate from a basis of the center portion, wherein each lateral portion comprises at least one hole, which is surrounded by a crown of adjacent separate tabs, whose folding upwards permits insertion of a neck of a respective bottle and prevents the bottle from coming out of said hole, wherein a median aperture has an upper portion extending through said center portion and lower portions extending through a proximal part of each lateral portion, wherein the upper portion allows the insertion of hand fingers of a user, and wherein each lateral portion comprises a longitudinal folding line which is intermediate between the basis of the center portion and a distal side of the lateral portion.

Preferred embodiments of the bottle carrier of the present invention are also described In a particularly preferred embodiment, at least one reinforcing wing protrudes within said upper portion of the aperture and is foldable towards a surface area of said center portion above said upper portion of the aperture.

A further subject-matter of the present invention is constituted by a package comprising a multiple bottle carrier as above-disclosed and wherein the neck of a respective bottle is inserted through each hole of the side portions of the carrier.

The extension of the gripping aperture also in the proximal parts of the lateral portions together with the presence of longitudinal folding lines in these latter lateral portions renders the structure of the carrier of the invention suitably flexible during stacking, without compromising its resistance when gripped by a customer or user.

In particular, when two packages of the present invention are stacked on each other, the center portion of the bottle carrier of the lower package translates vertically downwards, due to the weight of the bottles of the upper package, the extension of the aperture also in the lateral portions and the presence therein of the respective folding line. Hence, the center portion does not protrude any more upwards and does not hinder the stacking of the upper package.

On the other hand, once the superposed packages are unstacked, the center portion of the carrier of the lower package returns into its original protruding configuration without having been damaged, so that the aperture can be gripped by the user in the usual way, when necessary.

According to a preferred feature of the present invention, when a user inserts his hand fingers within the aperture in order to grip the package, the fingers bring about the folding of one or more wings protruding within the aperture towards a surface area of the center portion above the aperture. Such folding meaningfully strengthens this latter part of the center portion which is the most stressed, once the package is raised by the user.

BRIEF DESCRIPTION OF THE DRAWINGS

Further advantages and features of the present invention will be apparent from the following detailed description, given by way of non-limiting example with reference to the appended drawings, wherein.

DETAILED DESCRIPTION

Figure 1:
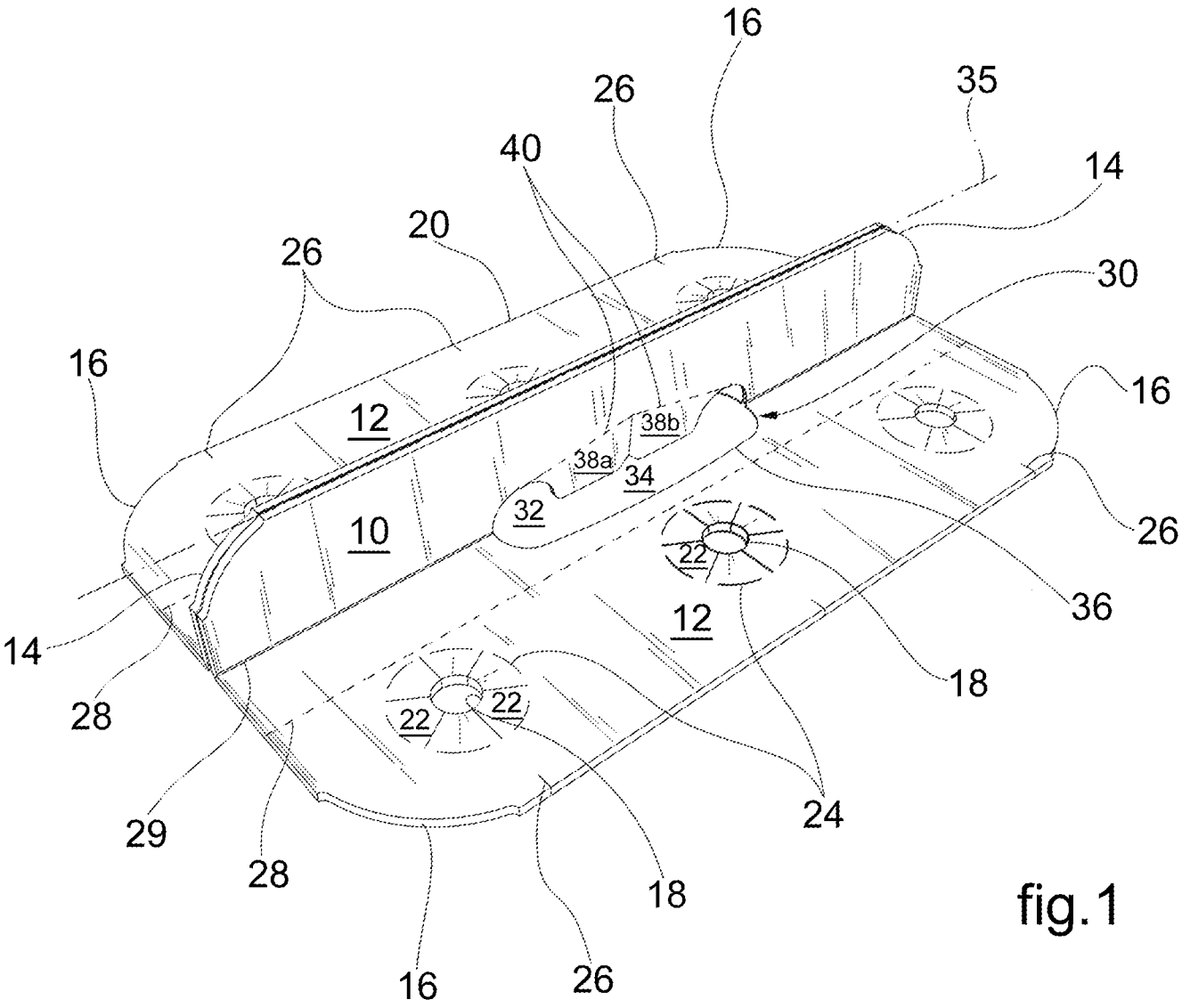
FIG. 1 is a perspective view of a first embodiment of a bottle carrier according to the present invention.

FIG. 1 illustrates a multiple bottle carrier of cardboard or the like cellulosic material, having a vertically arranged center portion 10 and two lateral portions 12 which are substantially orthogonally arranged with respect to the center portion 10 and thus lie in a horizontal plane.

The center portion 10 is substantially rectangular and has recessed rounded top corners 14 and also each lateral portion 12 is substantially rectangular and has recessed rounded distal corners 16.

Each lateral portion 12 has three holes 18, whose centers are arranged along a line parallel to a distal side 20 thereof.

Each hole 18 is circular and surrounded by a crown of adjacent separate tabs 22 having bases, which collectively form a circumference 24 concentric to the respective hole 18, so that each tab 22 is shaped as a sector of the crown. As it will be successively illustrated with specific reference to FIG. 3, the tabs 22 can be folded upwards in respect of the circumference 24 and allow the insertion of a neck of a respective bottle.

The distal side 20 of each lateral portion 12 has respective transversal or orthogonal cuts 26 directed towards each of the holes 18.

Each lateral portion 12 has a longitudinal folding line 28, such as a crease line, which is intermediate between and parallel to a basis 29 of the center portion 10, from which the lateral portions 12 originate, and the distal side 20 of the respective lateral portion 12. Each folding line 28 is also tangent to the circumferences 24 concentric to the holes 18.

A median aperture 30 has an upper portion 32 extending through the center portion 10 and two lower portions 34 extending through a proximal part of the respective lateral portion 12.

The shape of the aperture 30 is oblong and each lower portion 34 has a slightly curved distal edge 36. Two first reinforcing wings 38*a* facing to each other and two second reinforcing wings 38*b* facing to each other protrude within the upper portion 32 of the aperture 30 and are aligned in succession along a median longitudinal axis 35. Each wing 38*a*, 38*b* has a trapezoidal shape whose major basis is constituted by a respective folding line 40 by which it is attached to the main body of the center portion 10. The folding lines 40 of each couple of aligned wings 38*a*, 38*b* form a V-shaped profile.

The previously disclosed bottle carrier is obtainable from a single blank (see FIG. 2) which is symmetric in respect of both the median longitudinal axis 35 and a further central orthogonal axis 45. In more detail, the blank is folded, first of all, in respect of a crease line coinciding with the longitudinal axis 35, and then in respect of further crease lines constituting the basis 29 of the center portion 10. Finally, upper panels 44 above the basis 29 are attached, in particular glued, together, forming the center portion 10 having a thickness which is twice the thickness of each lateral portion 12.

According to an alternative embodiment of the invention not illustrated in the figures, the same bottle carrier illustrated in FIG. 1 is obtainable by joining two half-blanks, in each of which a lateral portion 12 and an upper panel are defined, wherein the upper panels of the two half-blanks are glued together forming the center portion 10.

Figure 3:
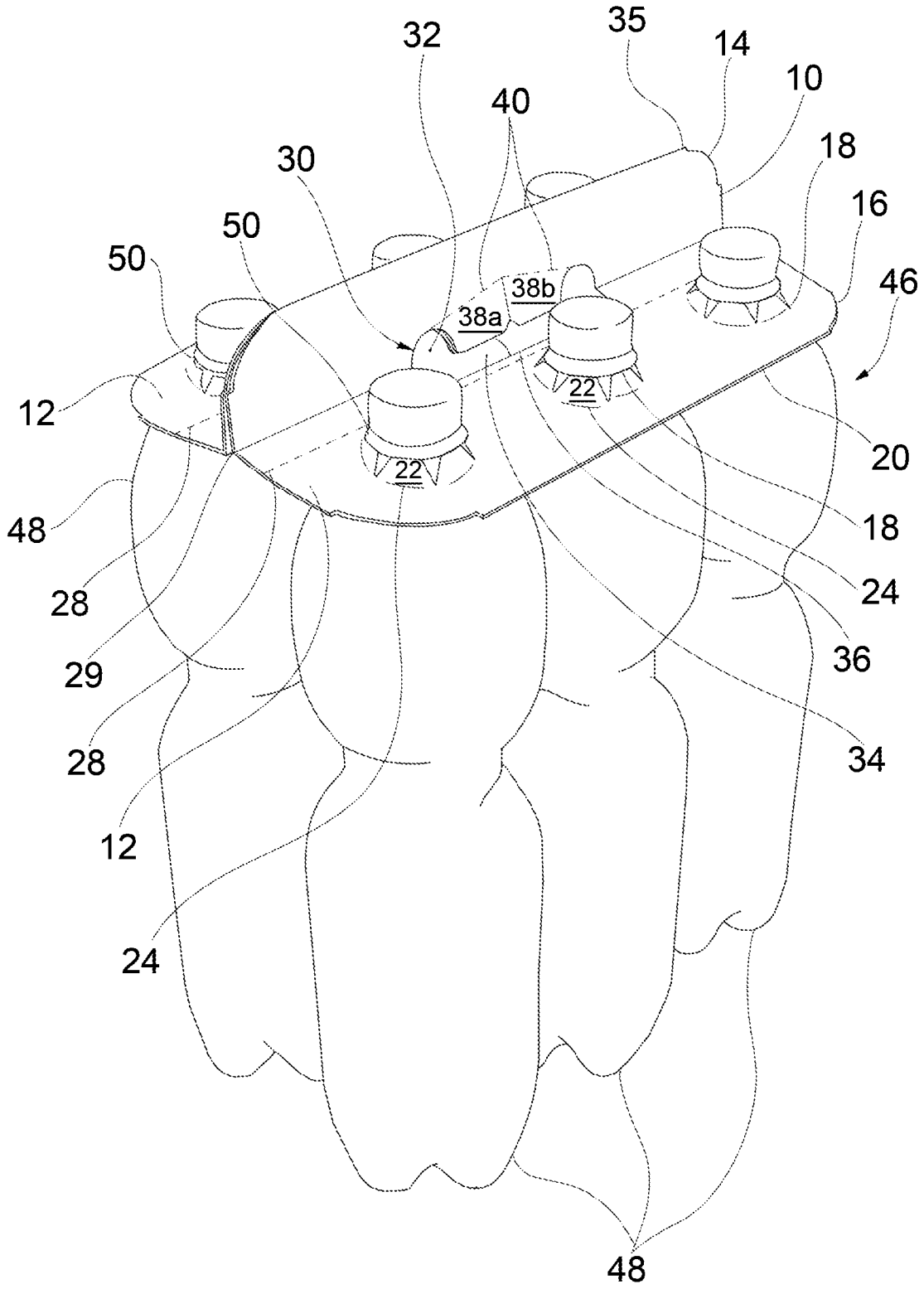
FIG. 3 is a perspective view of a package including the bottle carrier of FIG. 1 carrying a plurality of bottles.

FIG. 3 illustrates a package 46 which is obtained by inserting the neck of a respective bottle 48 though each hole 18 of the bottle carrier.

Such insertion folds upwards the tabs 22 in respect of the circumference 24, so as the tips of the tabs 22 are directed under a collar 50 circumferentially and transversally protruding from the neck of the bottle 48, which is thus prevented from incidentally coming out of the hole 18.

Two longitudinal rows, each of which comprises three bottles 48, are present in the package 46 and parallel to the axis 35.

When two packages 46 are stacked on each other, the center portion 10 of the bottle carrier of the lower package 46 translates vertically downwards, due to the weight of the bottles 48 of the upper package 46, the extension of the aperture 30 also in the lateral portions 12 and the presence of the folding lines 28 in the lateral portions 12.

Hence, the center portion 10 does not protrude any more upwards and cannot hinder the stacking of the upper package 46.

Vice versa, once the two packages 46 are unstacked, the center portion 10 of the carrier of the lower package 46 returns into its original configuration without having been damaged, and the protruding upwards aperture 30 of the center portion 10 can be gripped by a user, when it is desired to carry the package 46.

In particular, when the user inserts his hand fingers within the aperture 30, the center portion 10 acts as a handle, which can be comfortably and safely gripped.

It has to be emphasized that the insertion of the hand fingers within the aperture 30 brings about also the folding of the wings 38*a*, 38*b* about the respective folding lines 40 towards a surface area of the center portion 10 above the upper portion 32 of the aperture 30. Accordingly, such folding duly reinforces the part of the center portion 10 which is more stressed when the package 46 is raised by the user who carries its weight.

It has also to be noticed that, during carrying, the cohesion of the package 46 is increased by the contact between the lateral surfaces of the bottles 48 inserted though the holes 18 of each lateral portion 12.

If desired, two further six-bottle packages without any handle can be respectively attached at each side of the above bottle carrier and thus form an assembly which can be carried by gripping solely the center handle of the former bottle carrier.

Figure 2:
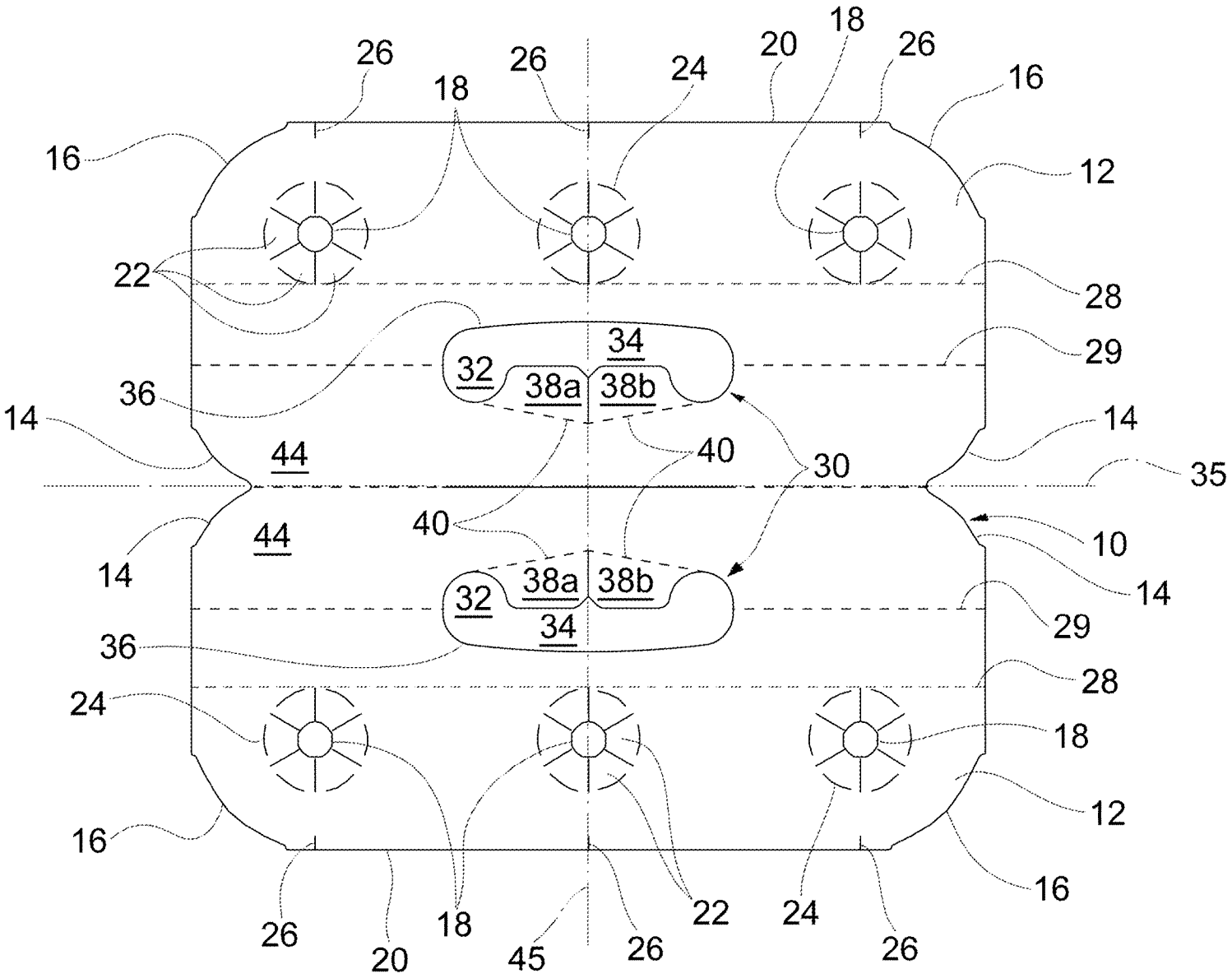
FIG. 2 is a top plan view of a blank suitable for the production of the bottle carrier of FIG. 1.
Figure 4:
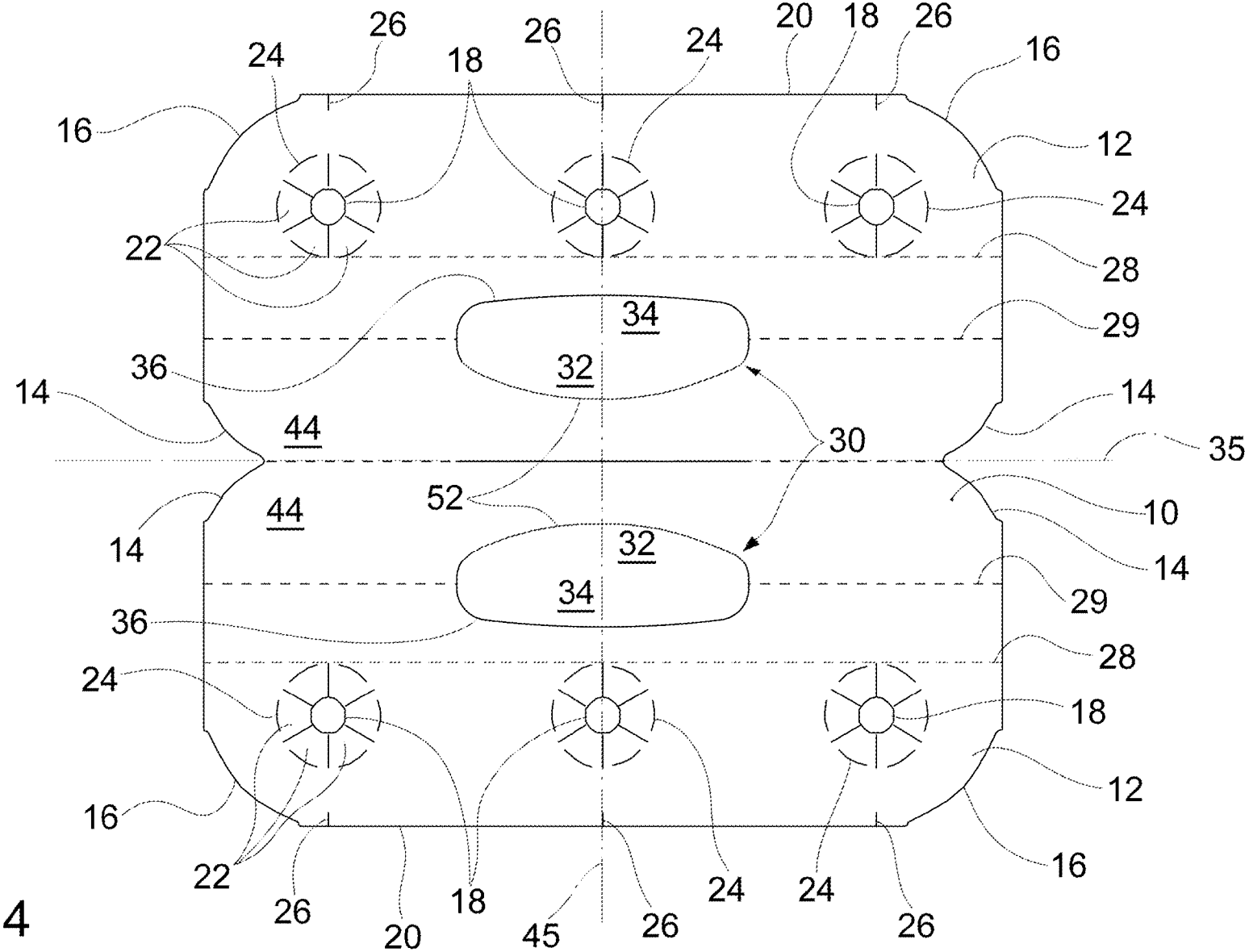
FIG. 4 is a top plan view of a further blank suitable for the production of another embodiment of bottle carrier according to the present invention.

FIG. 4 illustrates a further blank suitable for the production of another embodiment of bottle carrier according to the present invention, wherein features equal or equivalent to the ones disclosed with reference to the embodiment of the previous FIGS. 1 to 3 have the same reference number.

The only substantive difference between this latter embodiment and the former embodiment resides in the absence of any strengthening foldable wings within the aperture 30. The upper portion 32 of the aperture 30 has thus an upper curved edge 52 whose curvature is greater in correspondence of each end which—as in the former embodiment—is smoothly connected to a respective end of the distal edge 36 of the lower portion 34.

The remaining features of this latter bottle carrier substantially correspond to the ones mentioned in respect of the former embodiment, so that the functionalities and the associated advantages in stacking and unstacking are the same.

Figure 5:
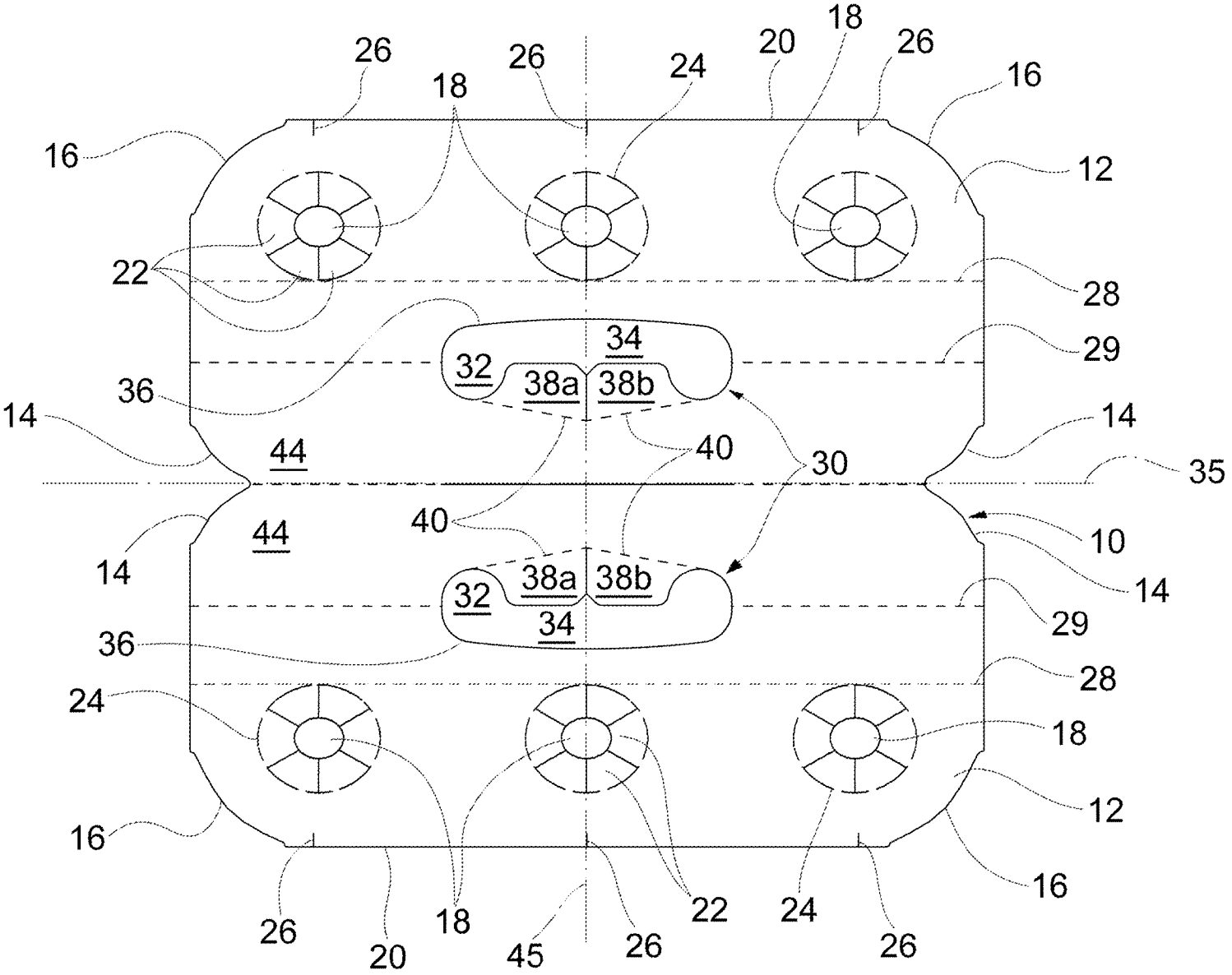
FIG. 5 is a top plan view of a further blank suitable for the production of still another embodiment of bottle carrier according to the present invention.

FIG. 5 illustrates a further blank suitable for the production of another embodiment of bottle carrier according to the present invention, wherein features equal or equivalent to the ones disclosed with reference to the embodiment of the previous FIGS. 1 to 3 have the same reference number.

The only substantive difference between this latter embodiment and the embodiment of FIGS. 1 to 3 resides in the fact that each hole 18 is oval or elliptical and surrounded by a crown of adjacent separate tabs 22 having bases, which collectively form an oval or ellipse 24 concentric to the respective hole 18. This elliptical/oval shape increases the tolerances for applying the tabs 22 to the bottles allowing for the tabs 22 to compensate on the bottle movement/variation in position and alignment.

The remaining features of this latter bottle carrier substantially correspond to the ones mentioned in respect of the former embodiment, so that the functionalities and the associated advantages in stacking and unstacking are the same.

Of course, the principles of the invention remaining the same, the details of construction and embodiments may be widely varied with respect to those described purely by way of example, without thereby departing from the claimed scope. E.g., each lateral portion can carry any desired number of bottles, whose global weight is compatible with the mechanical resistance of the carrier, and/or the distal corners of the center and lateral portions may be cut, chamfered or even not rounded at all.

The invention claimed is:

1. A multiple bottle carrier, comprising a center portion and two lateral portions which are orthogonally arranged with respect to the center portion and originate from a basis of the center portion, wherein each lateral portion comprises at least one hole, which is surrounded by a crown of adjacent separate tabs, whose folding upwards permits insertion of a neck of a respective bottle and prevents the bottle from coming out of said hole, wherein a median aperture has an upper portion extending through said center portion and lower portions extending through a proximal part of each lateral portion, wherein the upper portion allows insertion of hand fingers of a user, and wherein each lateral portion comprises a longitudinal folding line which is intermediate between the basis of the center portion and a distal side of the lateral portion.

2. The multiple bottle carrier of claim 1, wherein said center portion and each lateral portion are substantially rectangular.

3. The multiple bottle carrier of claim 2, wherein said center portion and each lateral portion have recessed rounded top corners and recessed rounded distal corners, respectively.

4. The multiple bottle carrier of claim 1, wherein the distal side of each lateral portion has at least one transversal cut directed towards said at least one hole.

5. The multiple bottle carrier of claim 1, wherein said at least one hole is circular and the tabs of the respective crown have bases collectively forming a circumference concentric to the respective hole, so that each tab is shaped as a sector of said crown.

6. The multiple bottle carrier of claim 5, wherein each lateral portion comprises two or three holes, whose centers are arranged along a line parallel to said distal side and said longitudinal folding line.

7. The multiple bottle carrier of claim 5, wherein said longitudinal folding line is tangent to said circumference.

8. The multiple bottle carrier of claim 7, wherein two first reinforcing wings facing to each other and two second reinforcing wings facing to each other protrude within said upper portion of the median aperture and are aligned along a median longitudinal axis.

9. The multiple bottle carrier of claim 1, wherein said at least one hole is oval or elliptical and the tab of the respective crown have bases collectively forming an oval or ellipse concentric to the respective hole, so that each tab is shaped as a sector of said crown.

10. The multiple bottle carrier of claim 9, wherein each lateral portion comprises two or three holes, whose centers are arranged along a line parallel to said distal side and said longitudinal folding line.

11. The multiple bottle carrier of claim 9, wherein said longitudinal folding line is tangent to said oval or ellipse.

12. The multiple bottle carrier of claim 1, wherein at least one reinforcing wing protrudes within said upper portion of the median aperture and is foldable towards a surface area of said center portion above said upper portion of the median aperture.

13. The multiple bottle carrier of claim 1, wherein the multiple bottle carrier is obtainable by folding a single blank and attaching together two upper panels of the single blank, so that the center portion, whose thickness is twice a thickness of each lateral portion, is formed.

14. The multiple bottle carrier of claim 13, wherein the multiple bottle carrier is obtainable by folding the single blank and gluing together the two upper panels of the single blank.

15. The multiple bottle carrier of claim 1, wherein the multiple bottle carrier is obtainable by attaching together two half-blanks, in each of which a lateral portion and an upper panel are defined, and wherein the upper panels of the two half-blanks are attached together forming said center portion.

16. The multiple bottle carrier of claim 15, wherein the upper panels of the two half-blanks are glued together.

17. A package comprising the multiple bottle carrier of claim 1, wherein the neck of a respective bottle is inserted through the at least one hole.

18. The multiple bottle carrier of claim 1, wherein the multiple bottle carrier is made of cardboard.

* * * * *